US005890628A

United States Patent [19]

Simpson et al.

[11] Patent Number: 5,890,628

[45] Date of Patent: Apr. 6, 1999

[54] DISPENSING LID ASSEMBLY FOR A CONTAINER

[75] Inventors: Peter C. Simpson, Glencoe, Ill.; John W. Lai, San Francisco, Calif.; Thomas J. Melk, Chicago, Ill.

[73] Assignee: Outer Circle Products, Ltd., Chicago, Ill.

[21] Appl. No.: 820,049

[22] Filed: Mar. 18, 1997

[51] Int. Cl.[6] ..... B67D 5/60

[52] U.S. Cl. ..... 222/131; 222/531; 222/534; 222/556

[58] Field of Search ..... 222/131, 183, 222/481.5, 531, 534, 556

[56] References Cited

U.S. PATENT DOCUMENTS

| | | | |
|---|---|---|---|
| D. 262,856 | 2/1982 | MacTavish et al. . | |
| D. 268,469 | 4/1983 | Ruxton et al. . | |
| D. 279,346 | 6/1985 | Ruxton . | |
| D. 294,325 | 2/1988 | Fiore, Jr. . | |
| D. 338,130 | 8/1993 | Costello . | |
| 3,874,562 | 4/1975 | Hazard . | |
| 4,219,138 | 8/1980 | Hazard | 222/534 |
| 4,892,234 | 1/1990 | Bennett | 222/534 X |
| 5,054,662 | 10/1991 | Santagiuliana | 222/531 |
| 5,477,994 | 12/1995 | Feer et al. | 222/531 X |

FOREIGN PATENT DOCUMENTS

| | | |
|---|---|---|
| 2209062 | 6/1974 | France . |
| 9615705 | 5/1996 | WIPO . |

*Primary Examiner*—Gregory L. Huson
*Attorney, Agent, or Firm*—Trexler, Bushnell, Giangiorgi & Blackstone, Ltd.

[57] ABSTRACT

A dispensing lid assembly which includes a rotatable spout for use with a container defining a container cavity. The container may be the type having deflectable sidewalls. The rotatable spout includes an arcuate ball portion and a nozzle portion. The arcuate rotator portion is retained on a base of the lid assembly to allow rotation thereof to align a through hole in the spout with a dispensing hole in the base. The arcuate rotator portion is configured to reduce the wear on a sealing gasket. A check valve assembly is attached to the base of the dispensing lid assembly. The check valve assembly includes a diaphragm which is pre-loaded within a valve chamber to provide a desired sealing effect between the diaphragm and the base portion. The check valve assembly is configured to pre-load forces on the diaphragm such that a desired inhaling force will unseat the diaphragm from the corresponding portion of the base to draw air therethrough. Upon equalization of the pressure within the container cavity and the ambient atmosphere, the diaphragm will return to seal against the base portion to prevent dripping therethrough.

23 Claims, 5 Drawing Sheets

FIG.10
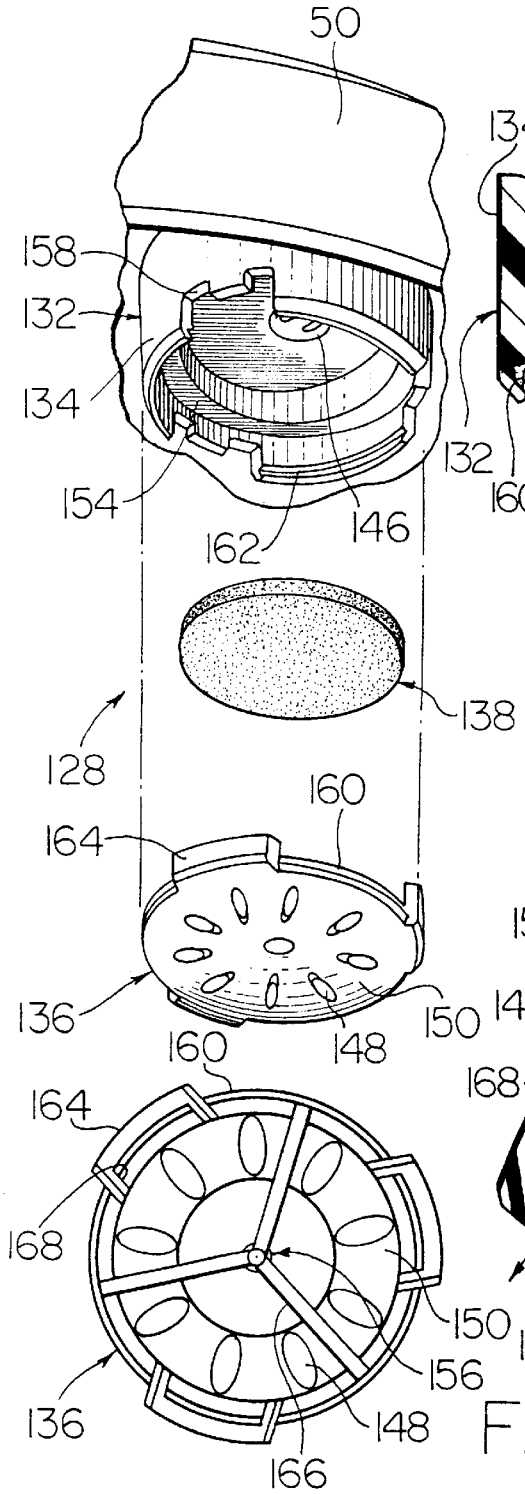
FIG.11
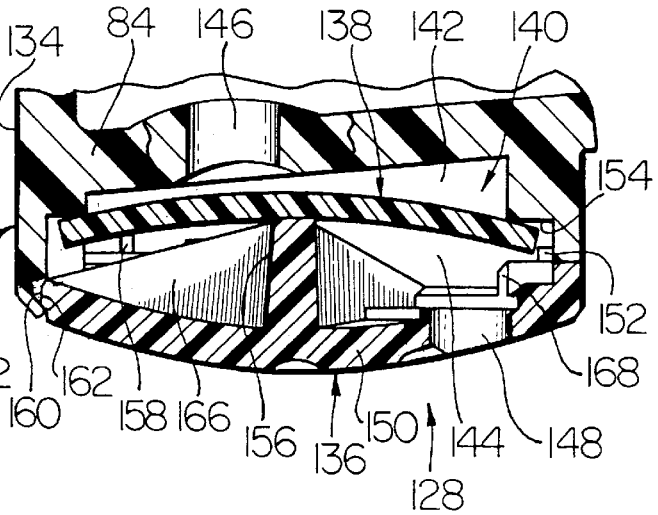
FIG.12
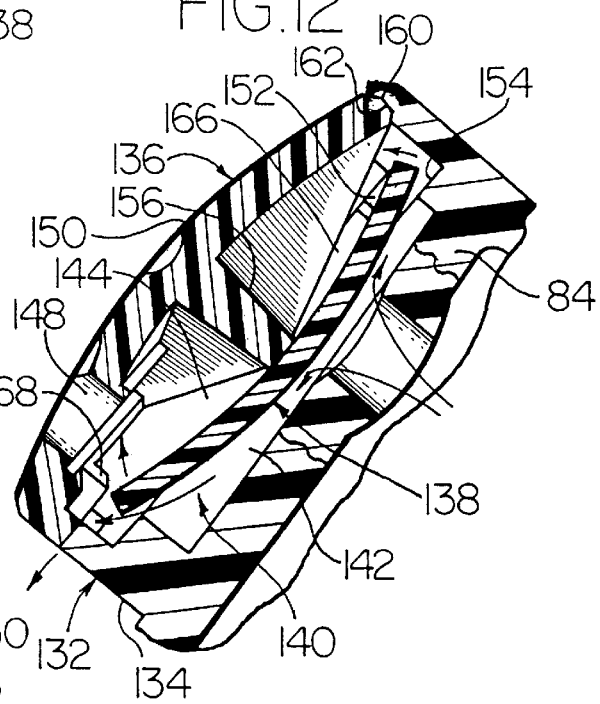
FIG.13

DISPENSING LID ASSEMBLY FOR A CONTAINER

BACKGROUND

The present invention envisions a dispensing lid for use with a container.

Dispensing lids are available which include a displaceable spout. However, these prior art lid assemblies generally must be used with a container having generally rigid, generally non-deflectable side walls. A rigid container is required due to the fact that such lid assemblies typically vent air into the container through the spout. This type of arrangement may develop a substantial inhaling force or vacuum in the container cavity and as a result create inwardly drawing forces on the container side walls. Such prior art lids operate in a satisfactory manner when used with a rigid container having non-deflectable walls which can withstand the vacuum created therein without collapsing.

In contrast, when a generally rigid, yet flexible container is used, such dispensing lid tend to draw the walls of a flexible container inwardly. Inhaling forces created during the dispensing of liquid through the spout tend to overcome the strength of the container wall thereby pull the container walls inwardly. As such, these prior art dispensing lids have not been used with lightweight flexible containers.

As a result of having a rigid container construction, container assemblies which employ a dispensing lid tend to be rather cumbersome. The cumbersome products are also are generally heavier and may not provide sufficient thermal efficiency.

One way in which the prior art has tried to overcome these problems of venting air other than through the dispensing spout is by the addition of a vent hole. However, vent holes in dispensing lids tend to result in dripping of water through the venting holes. If the size of the venting holes are reduced in order to minimize the dripping, the holes tend to be so small that adequate venting is not achieved thereby resulting in at least partially collapsing of the container walls.

As an additional factor, the prior art tends to create a pulsing or "burping" flow of water through the dispensing spout. In a rigid wall container, burping occurs when the flow is momentarily stopped as the inhaling forces overcome the head forces of the water in the container and outward flow forces of the water. The stream of fluid flowing from the container is momentarily stopped to draw air into the container and once the pressure inside the container is generally equalized relative to the ambient atmosphere, flow is resumed with a rush of water through the dispensing spout. Such pulsing flow can be unpredicatable and results in splashing of the liquid when dispensed from the container. The pulsing flow will also occur in a container having a somewhat flexible wall design in which the lid includes a venting hole.

As an additional matter, dispensing lids which include a rotatable spout typically include a design in which a ball portion is retained in a seat of the lid. The ball and the seat design tends to result in an unstable spout such that over extension of the spout might disengage the ball from the seat. This disengagement of the ball from the seat could result in uncontrolled flow of fluid from the container.

Additionally, prior art ball and seat design tends to result in leaking between the ball and seat. Although the prior art structures may employ an o-ring or other gasket, the design of the prior art ball and seat structure tends to wear the o-ring such that it prevents proper sealing.

OBJECTS AND SUMMARY

A general object of the present invention is to provide a dispensing lid assembly which includes a rotatable spout.

A further object of the present invention is to provide a dispensing lid assembly which includes a check valve which generally controls the inflow of air into an associated container cavity.

A further object of the present invention is to provide a dispensing lid which reduces the wear on a sealing gasket positioned between an arcuate rotator portion and a base portion of the lid.

Briefly, and in accordance with the foregoing, the present invention envisions a dispensing lid assembly which includes a rotatable spout. The rotatable spout includes an arcuate rotator portion and a nozzle portion. The arcuate rotator portion is retained on a base of the lid assembly to allow rotation thereof to align a through hole in the spout with a dispensing hole in the base. The arcuate rotator portion is configured to reduce the wear on a sealing gasket. A check valve assembly is attached to the base of the dispensing lid assembly. The check valve assembly includes a diaphragm which is pre-loaded within a valve chamber to provide a desired sealing effect between the diaphragm and the base portion. The check valve assembly is configured to pre-load forces on the diaphragm such that a predetermined inhaling force is required to unseat the diaphragm from the corresponding portion of the base to draw air therethrough. Upon equalization of the pressure within the container cavity and the ambient atmosphere, the diaphragm will return to seal against the base portion to prevent dripping therethrough.

BRIEF DESCRIPTION OF THE DRAWINGS

The organization and manner of the structure and function of the invention, together with further objects and advantages thereof, may be understood by reference to the following description taken in connection with the accompanying drawings, wherein like reference numerals identify like elements, and in which:

FIG. 10 is an enlarged, partial fragmentary, exploded perspective view of a check valve of the dispensing lid assembly showing a housing portion and a grate portion which attaches thereto to retain a flexible diaphragm disc therebetween;

FIG. 11 is an enlarged, partial fragmentary, cross-sectional, side elevational view of the check valve similar to that as shown in FIG. 4 in which the valve is sealed to prevent escape of water from the container cavity;

FIG. 12 is an enlarged, partial fragmentary, cross-sectional, side elevational view of the check valve as shown in FIG. 5 in which the diaphragm has been displaced to allow air to flow inwardly into the container cavity; and FIG. 13 is an enlarged, interior plan view of the grate of the check valve showing the internal structures thereof.

DESCRIPTION

Figure 1:
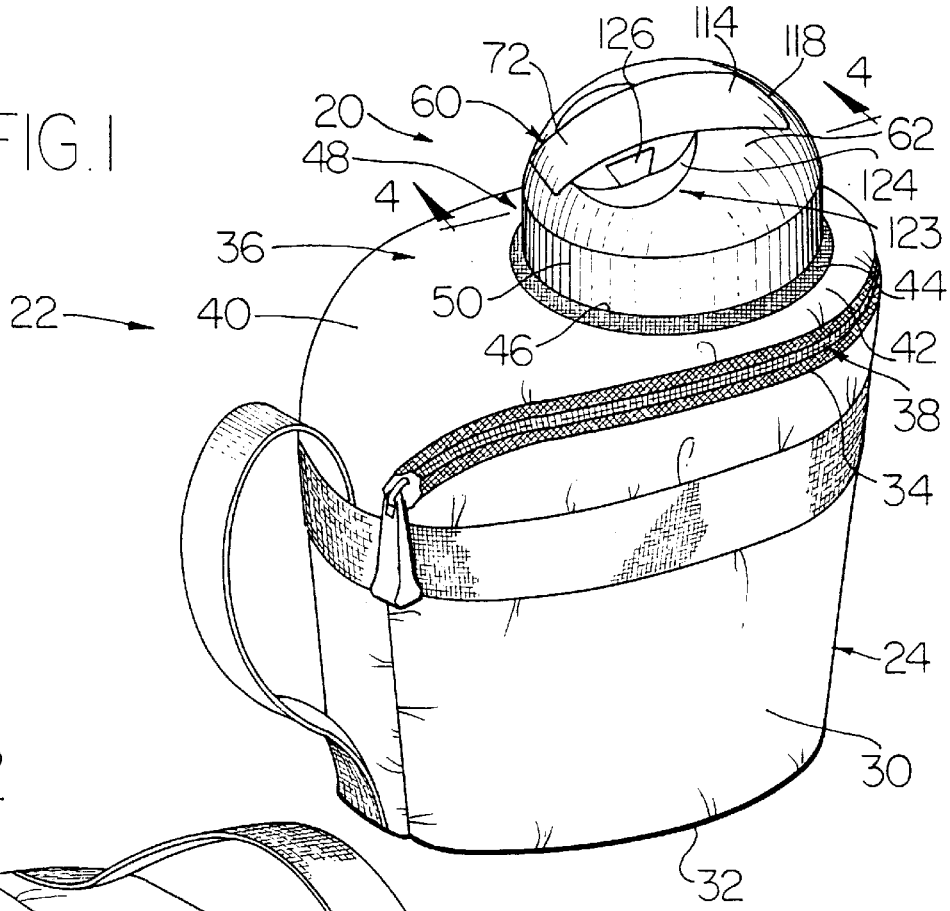
FIG. 1 is a top, left, perspective view of a container assembly including a dispensing lid assembly of the present invention.

While the present invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

Figure 2:
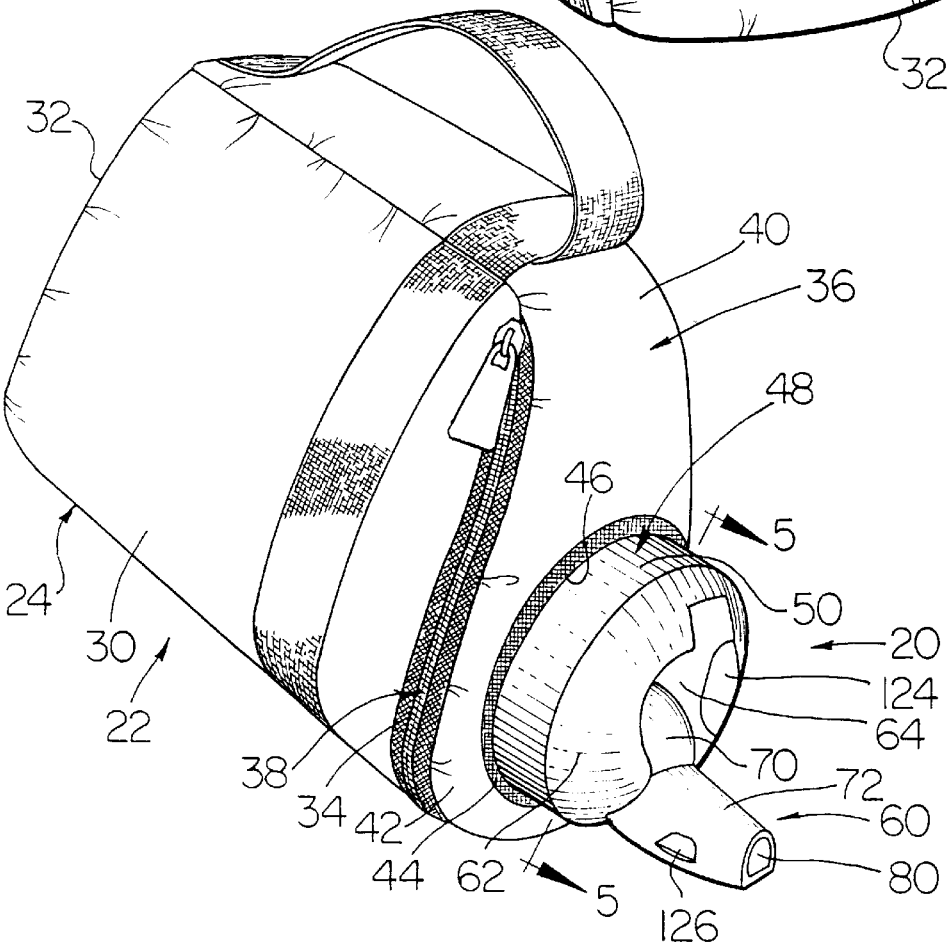
FIG. 2 is a top, side, perspective view of the container assembly as shown in FIG. 1 in which a rotator spout has been pivoted away from a base portion of the dispensing lid assembly for dispensing fluids through a nozzle portion.
Figure 3:
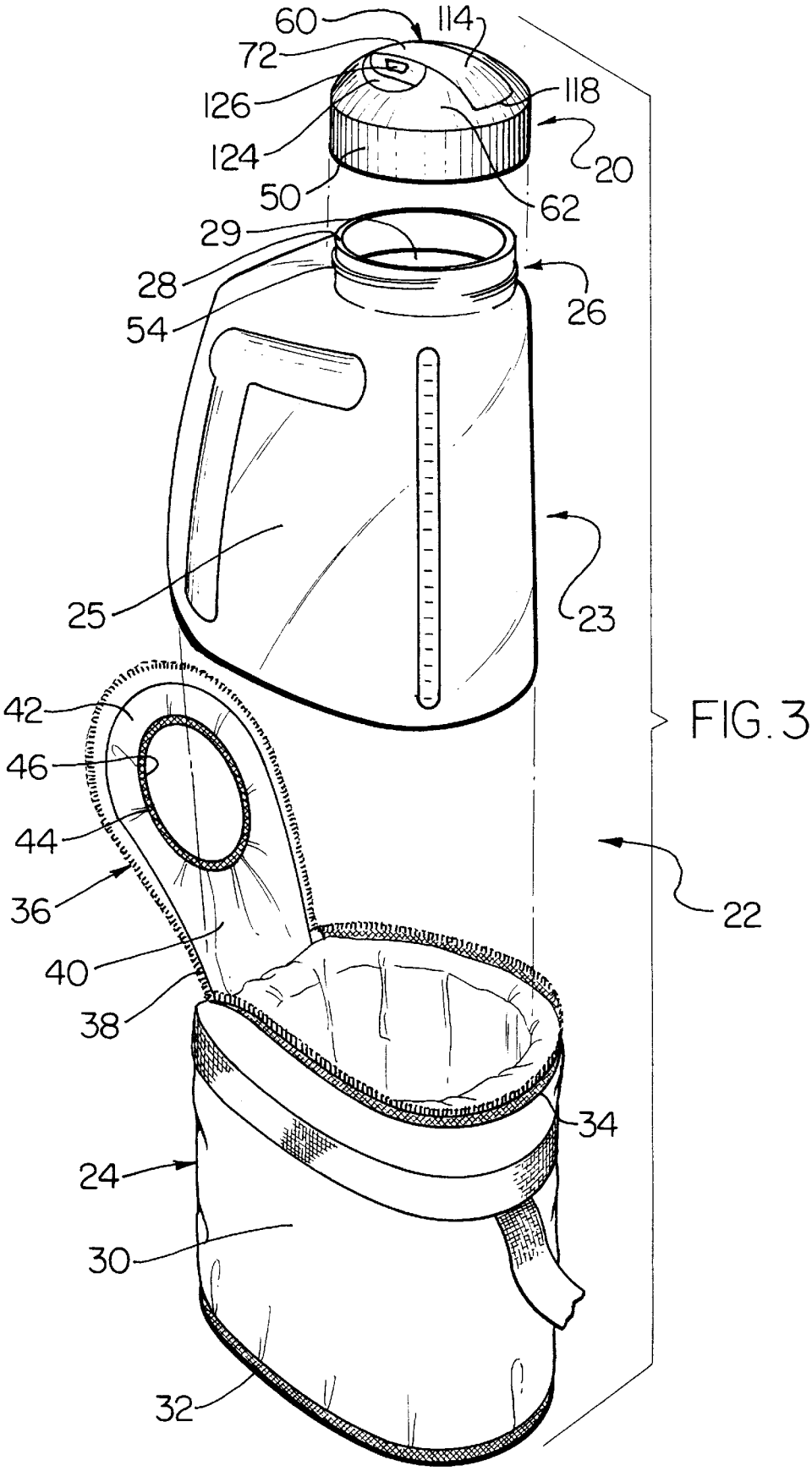
FIG. 3 is an exploded, perspective view showing the dispensing lid assembly of the present invention exploded from a thin walled container which has been removed from an insulated jacket.

With reference to FIG. 1, a dispensing lid assembly 20 of the present invention is shown in use attached to a container assembly 22. The container assembly as shown in FIGS. 1–3 is one in which a thin walled container 23 is retained within an insulated jacket 24. The container 23 has generally rigid, thin walls 25 which provide a degree of flexibility or deflection. As discussed in greater detail below, while the walls flex, the dispensing lid assembly of the present invention prevents inward flexing and displacement of the walls while dispensing liquid therefrom.

Figure 4:
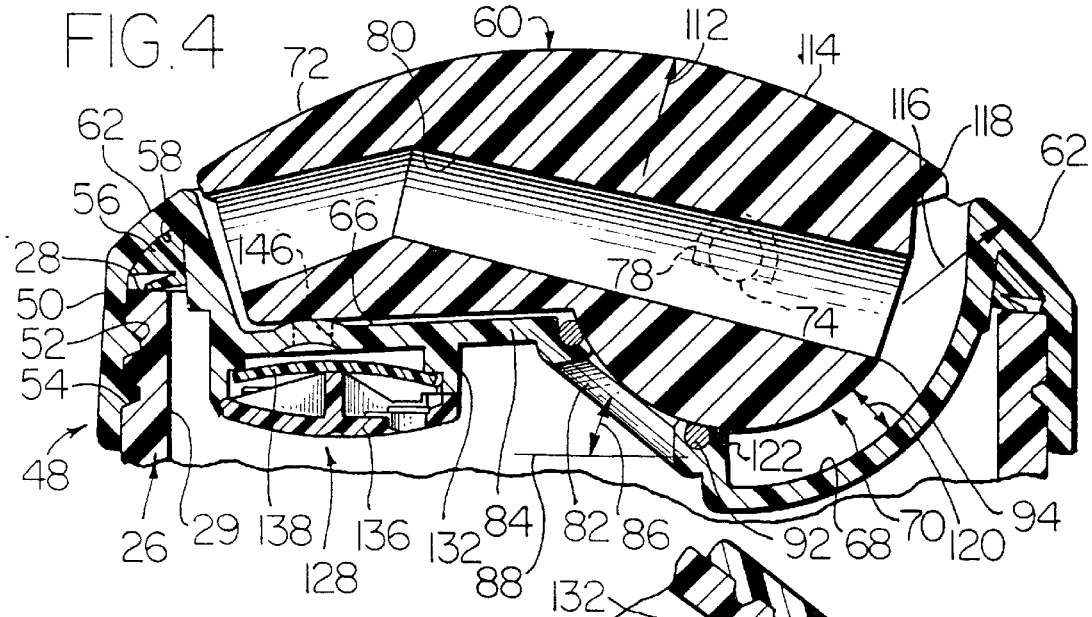
FIG. 4 is an enlarged, partial fragmentary, cross-sectional, side elevational view taken along line 4—4 through the dispensing lid assembly as shown in FIG. 1.

With reference to FIGS. 3 and 4, the dispensing lid assembly 20 is attached to a neck portion 26 of the container 23 to cover a mouth 28 thereof. Liquids are retained in a cavity 29 of the container assembly 22 and dispensed through the dispensing lid assembly 20 as will be described in greater detail hereinbelow.

The container assembly 22 includes the insulated jacket 24 which has walls 30 extending upwardly from a foot 32 towards an upper edge 34. A hood 36 extends over the upper edge 34 and is retained in engagement with the walls 30 by means of a closure 38. The hood 36 includes a neck portion 40 and a head portion 42. A collar 44 is provided around an aperture 46 through which the neck 26 extends. A base portion 48 of the lid assembly 20 extends away from the top portion of the container assembly 22.

Having now briefly described the overall structure of the container assembly 22, we will focus on the structure and function of the dispensing lid assembly 20. The dispensing lid 20 includes a side wall 50. An interior surface of the side wall 50 includes threads 52 which threadedly engage corresponding threads 54 formed on an exterior surface of the neck 26. The threads 52,54 securely retain the lid 20 on the container assembly 22. A gasket 56 is retained in an annular channel 58 to form a seal between the mouth 28 and the lid 20.

The lid assembly 20 further includes a displaceable spout or rotator spout 60. An upper portion of the lid 20 defines a partially domed head 62 which includes a spout recess area 64 formed therein. The spout recess 64 includes a plateau area 66 and a basin area 68. The plateau and basin areas 66,68 accommodate the spout 60 in a folded down or closed position. An arcuate portion 70 of the spout 60 is retained in the basin area 68 and a nozzle portion 72 nests in the plateau area 66. The spout 60 is pivotally retained in the spout recess 64 by a boss 74 extending from the side walls 76 of the spout recess 64 and a saddle 78 formed on a corresponding surface of the arcuate portion 70.

Figure 5:
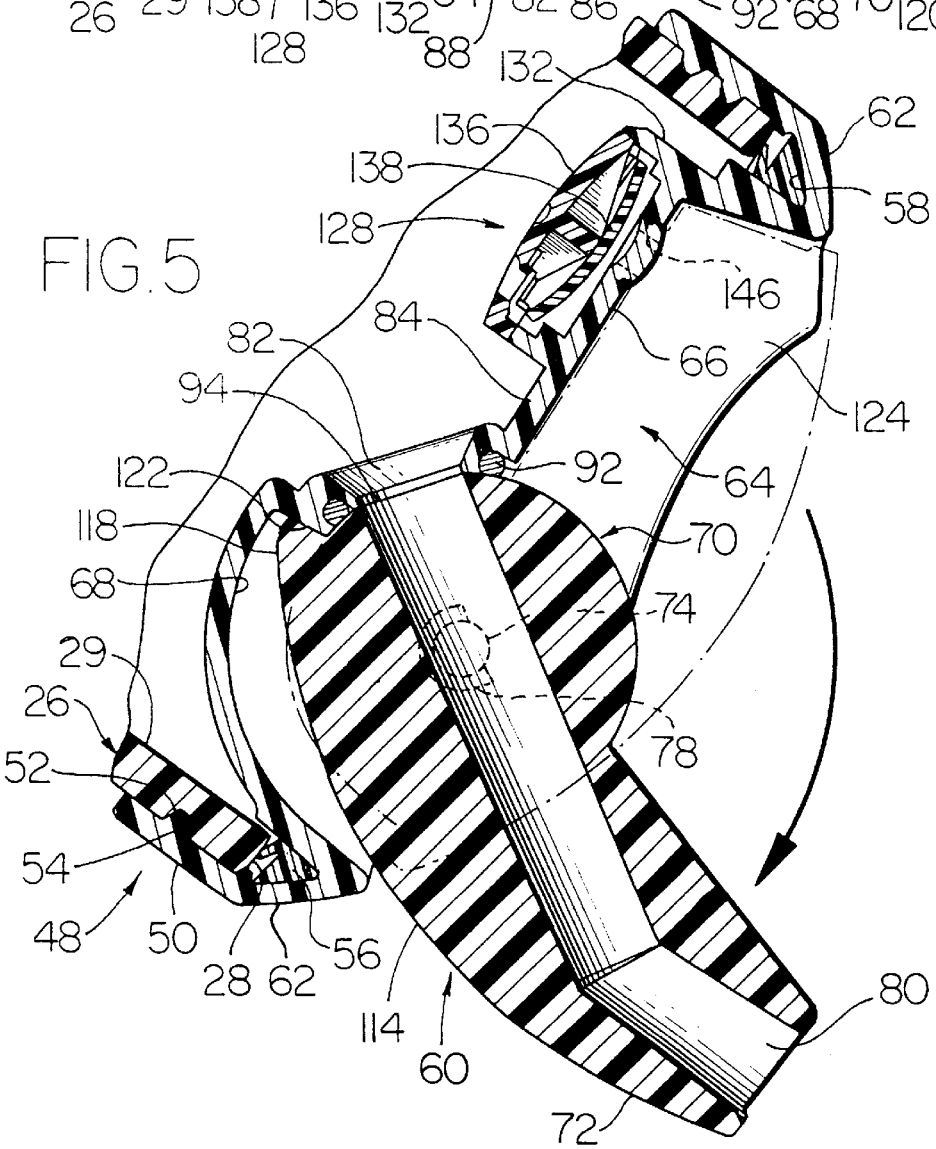
FIG. 5 is an enlarged, partial fragmentary, cross-sectional, side elevational view taken along line 5—5 of the dispensing lid assembly as shown in FIG. 2 in which the rotator spout portion has been rotated to align a through hole in the spout with a dispensing hole in the base portion.

With reference to FIGS. 1 and 4, the spout 60 is shown in the closed position. With further reference to FIGS. 2 and 5, the spout 60 is shown in the open position. As can be seen in the figures, the spout 60 includes a through bore 80 which extends from the arcuate portion 70 to and through the nozzle portion 72. A dispensing aperture 82 extends through a wall 84 of the base portion 48 in the spout recess area 64. As shown in FIGS. 4, 5, 6 and 9, the dispensing aperture 82 is disposed at an angle (as indicated by angle 86 relative to a horizontal reference, as shown by reference 88). In the closed position, an arcuate external surface 90 of the arcuate portion 70 is positioned over the dispensing aperture 82 with a gasket 92 positioned externally of the dispensing aperture 82 forming a seal between the corresponding base portion and the spout 60. When the spout 60 is rotated into the open position (see FIGS. 2, 5, 6 and 7), an entry port 94 of the through bore 80 is aligned with the dispensing aperture 82.

Figure 6:
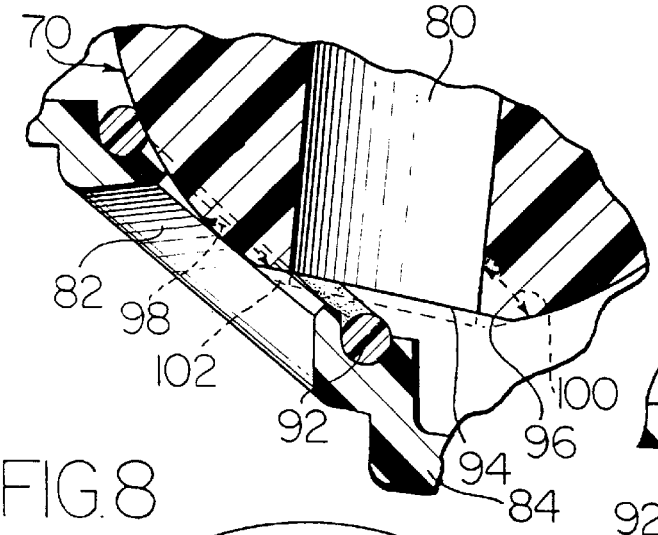
FIG. 6 is an enlarged, partial fragmentary, cross-sectional, side elevational view of a portion of the arcuate rotator to illustrate a chord rim which is positioned around an entry port of the through hole in the rotator spout and also showing the rotation of the rotator spout from a closed position to a dispensing position.
Figure 7:
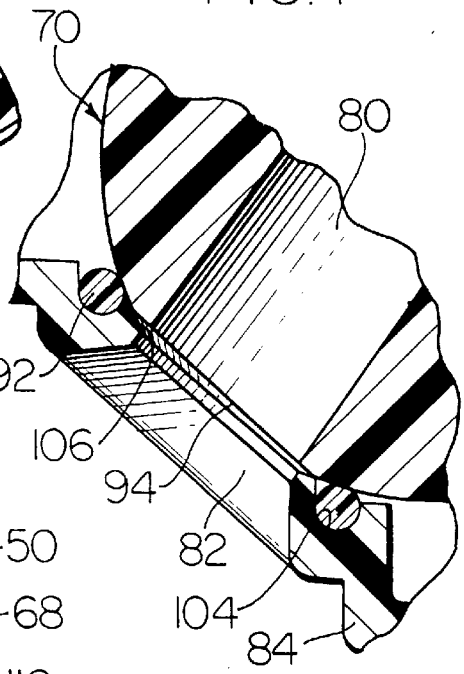
FIG. 7 shows the partial fragmentary, cross-sectional view as shown in FIG. 5 in which the rotator spout has been positioned to the dispensing position.
Figure 8:
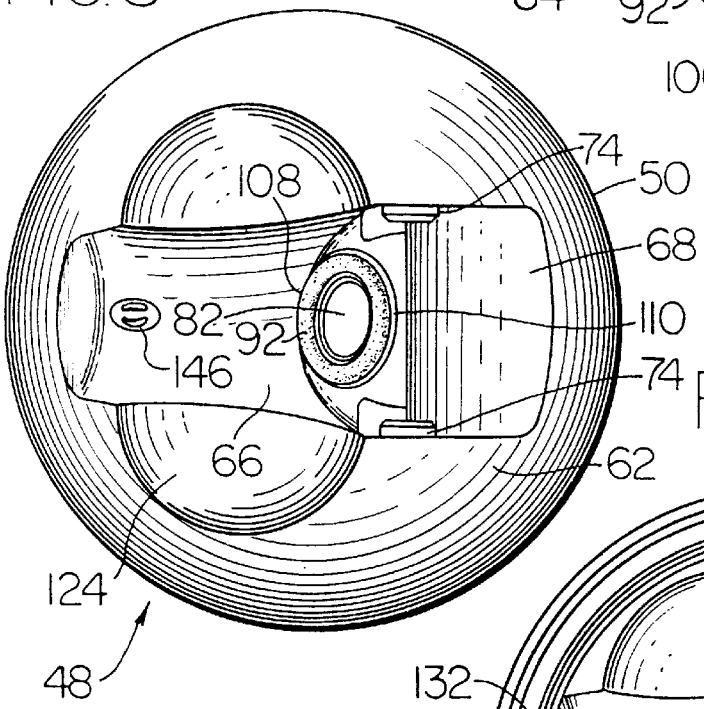
FIG. 8 is a top plan view of the base portion of the dispensing lid assembly in which the rotator spout has been removed.
Figure 9:
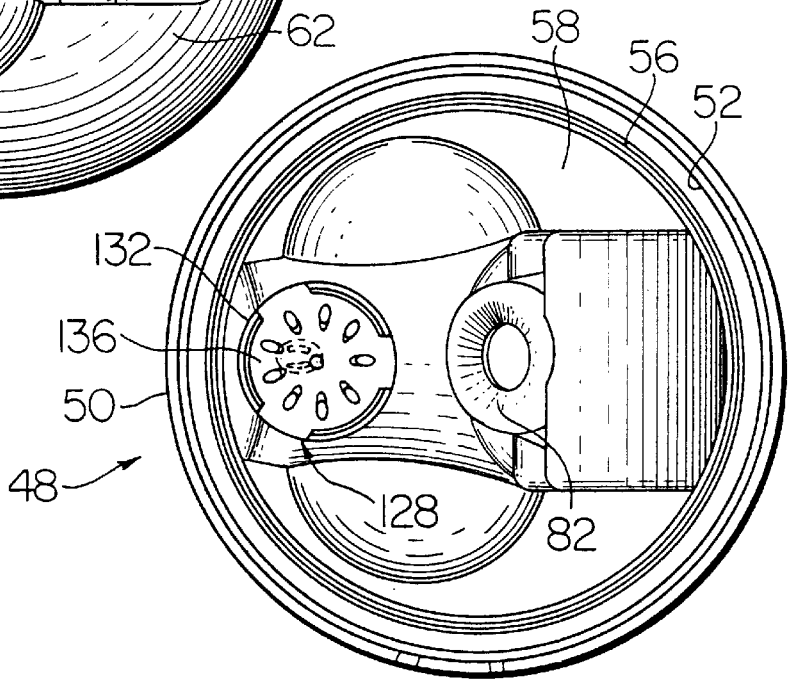
FIG. 9 is a bottom plan view of the dispensing lid assembly.

With further reference to the enlarged illustrations as shown in FIGS. 6 and 7, a chord rim or surface 96 is disposed around the entry port 94. An obtuse angle, as indicated by angle 98, is formed between the chord rim 96 and the arcuate exterior surface 90 of the arcuate portion 70. In FIG. 6, the arcuate portion is shown as being rotated towards the open position.

The chord rim 96 is an improvement over the prior art structure which is shown in phantom line in FIG. 6. As can be seen by comparison of the present invention to the phantom line illustration of the prior art, the prior art resulted in an acute angle (as indicated by angle 100) between the arcuate exterior surface 90. The acute angle 100 created a sharp edge 102 at the entry port 94 which tended to wear against the gasket 92. In contrast, the present invention employs the chord rim 96 to reduce the point and sharpness at the entry port 94 thereby reducing the wear on the gasket 92 and increasing the life of the gasket 92 and providing a longer drip-free service life of the dispensing lid assembly 20. Rotation of the spout 60 to the open position generally results in minor deformation of the gasket 92 by the arcuate portion 70 generally with only little contact with angled edges which are formed at an obtuse angle 98.

Also as shown in FIGS. 6 and 7, the gasket 92 is mounted in a retaining ring groove 104. The retaining ring groove 104 is formed in the wall 84 at a position radially spaced away from the dispensing aperture 82. A retaining bevel 106 extends between the retaining ring groove 104 and the dispensing aperture 82. The retaining ring bevel 106 is asymmetric in that it includes a lower edge 108 which is narrower than an upper edge 110. The retaining bevel 106 and its asymmetric structure accommodate the arcuate surface of the arcuate surface 90 of the arcuate portion 70 to further facilitate smooth movement of the spout 60 from a closed position to an open position.

With reference to FIGS. 1–5 and 9, the dispensing lid assembly 20 of the present invention includes an upper exterior surface which is defined by a generally continuous coincident radius. As shown in FIG. 4, an exterior radius (as indicated by radius 112) of the cover surface 114 creates an arcuate surface which is generally coincident with the arcuate surface defining the partially domed head 62. The exterior radius (as indicated by radius 116) of the partially domed head 62 is generally equal to the radius 112 of the cover surface 114. A trailing end 118 of the spout 60 extending from the arcuate portion 70 covers a space to conceal the entry port 94 of the through bore 80. A space 120 is defined between the basin 68 and the arcuate portion 70 through which the trailing end 118 travels. Upon pivoting the spout 60, the trailing end 118 contacts a ledge 122 formed in the basin 68 which prohibits further rotation of the spout 60. The trailing end 118 prevents over rotation of the spout 60 and thereby prevents removal of the spout from the base portion 48.

In order to move the spout 60 from the closed position to the open position, a grip structure 123 is provided on the base 48 and the spout 60. On the base 48, a pair of concave grip reveal surfaces 124 are spaced on the partially domed head 62 on opposite sides of the nozzle 72. A user can insert their thumb and forefinger in corresponding areas defined by the nozzle 72 and grip reveal surfaces 124 to grasp the sides of the nozzle 72. Additionally, notches are provided on opposite sides of the nozzle 72 to further enhance gripping of the spout 60. When a user desires to open the dispensing lid assembly 20, he can insert his fingers in the revealed areas 124 and grip the notches 126 to lift up on the spout 60.

An additional feature of the present invention is a check valve assembly 128 disposed on the base portion 48. The check valve assembly 128 provides controlled introduction of air from the ambient atmosphere into the cavity 29 defined by the container walls 25. By introducing air into the cavity 29, the check valve assembly 128 provides controlled equalization of the pressure in the cavity 29. This is an important improvement over the prior art because prior art containers tended to either collapse a flexible walled container or to produce a pulsed dispensing of liquids from the container. The check valve assembly 128 of the present invention produces a generally continuous flow of liquid from the container through the spout 60 because equalizing air is introduced through the valve 128 and not through the nozzle 72 and because equalizing occurs thereby reducing the vacuum forces on the container walls 25.

The check valve assembly 128 includes a housing portion 132 generally defined by a wall 134, a cover or grate 136 and a diaphragm 138 retained in a valve chamber 140 defined between the grate 136 and the housing 132. The valve chamber 140 is divided into an exterior chamber 142 and an interior chamber 144. A vent port 146 extending through the wall 84 of the base provides communication between the exterior chamber 142 and the ambient atmosphere. On the other side of the diaphragm 138, holes 148 in a face wall 150 of the grate 136 and breather ports 152 in the wall 134 of the housing 132 provide communication between the cavity 29 and the interior chamber 44.

With further reference to FIGS. 11–13, the diaphragm 138 is positioned on a sealing structure 154 on an interior surface of the housing 132. The sealing structure 154 is in the form of a shoulder. A preloading protrusion 156 in the form of a post extends from an interior surface of the grate 136 and contacts the diaphragm 138 to apply preloading forces to the diaphragm 138. The preloading forces deflect the diaphragm 138 to increase the forces between the diaphragm 138 and the sealing structure 154. Depending on the variables in any given situation, the length of the preloading protrusion 156 and the desired degree of deflection of the diaphragm 138 can be selected to provide a predetermined sealing force between the diaphragm 138 and the sealing structure 154. In other words, a vacuum developed within the cavity 29 will have to achieve a level of force only slightly greater than the preloading forces on the diaphragm 138 at the sealing structure 154 to unseat the diaphragm 138 from the sealing structure 154. Once unseated, the diaphragm 138 allows air to pass from the exterior chamber 142 to the interior chamber 144 and the cavity 29.

The breather ports 152 are defined by gaps 158 in the wall 134. An annular rib 160 is provided on the perimeter of the grate 136 and engages a cooperatively formed groove 162 on the wall 134 of the housing 132. Legs 164, extend from the perimeter of the grate 136. While there are a number of holes 148 in the face wall 150, air primarily flows through the breather ports 152. The breather ports 152 are positioned in close proximity to the shoulder 154 and as such provides for a short flow path through the check valve assembly 128. The holes 148 allow the atmosphere in the cavity 29 or the water in the cavity 29 to act against the interior surface of the diaphragm 138. As such, as air is drawn from the exterior chamber 142 and through the breather ports 152, the inhaling forces tend to drop and once they fall below the seating forces of the diaphragm on the sealing structure 154, the check valve closes.

To additionally control the flow of air and the deformation of the diaphragm 138, tapered ribs 166 and stop walls 168 are provided on the grate 136. The ribs 166 prevent over-deflection and crumpling of the diaphragm 138 and promote uniform deflection of the diaphragm. The stop walls 168 limit the extent of deflection of the diaphragm when unseated from the sealing structure 154.

While a preferred embodiment of the present invention is shown and described, it is envisioned that those skilled in the art may devise various modifications and equivalents without departing from the spirit and scope of the invention as defined by the appended claims. The invention is not intended to be limited by the foregoing disclosure.

The invention claimed is:

1. A dispensing lid assembly for use with a container, said dispensing lid assembly comprising:

a base portion for attachment to the container, said base portion defining a spout recess area;

said spout recess area having a dispensing aperture therethrough communicating with a cavity of said container, said dispensing aperture being disposed at an angle relative to a horizontal reference;

a rotator spout pivotally retained in said spout recess area being pivotable from a closed position to an open position, said rotator spout having a through hole extending therethrough, said through hole communicating with said dispensing aperture when said rotator spout is pivoted into an open position and being displaced from communication with said dispensing aperture when said spout is pivoted into a closed position;

a gasket retained on said base portion surrounding said dispensing aperture for forming a seal between said rotator spout and said dispensing aperture;

a check valve positioned on said base portion, said check valve including a vent extending through a wall portion of said spout recess area and spaced from said dispensing aperture, a valve housing, a valve cover attached to said housing, and a flexible diaphragm retained between said cover and said housing;

an arcuate portion of said rotator spout having a generally convex exterior surface;

an annular chord rim surrounding an entry port portion of said through hole and said rotator spout defining an obtuse angle with said generally convex exterior surface of said arcuate portion for reducing the wear on said gasket retained proximate to said dispensing aperture.

2. A dispensing lid assembly as recited in claim 1, in combination with a container having deflectable side walls.

3. A dispensing lid assembly for use with a container to retain liquids in said container and to dispense liquids therefrom, said dispensing lid assembly comprising:

a base portion for attachment to said container;

said lid assembly defining a spout recess;

a rotator spout retained in and pivotable in said spout recess, said rotator spout having an arcuate portion and a nozzle portion extending from said arcuate portion, said arcuate portion and said nozzle having a through hole extending therethrough for dispensing liquids therethrough;

a wall in said spout recess having a dispensing aperture providing communication between a cavity defined by said container and said spout recess, said dispensing aperture being oriented such that its width extends at an acute angle relative to a horizontal reference; and said rotator spout being rotatable to position an entry port of said through hole in communication with said dispensing aperture.

4. A dispensing lid assembly as recited in claim 3, in combination with a container having deflectable side walls.

5. A dispensing lid assembly as recited in claim 3, further comprising said rotator spout having a cover surface extending along said arcuate portion and said nozzle portion for extending over said spout recess when said rotator spout is pivoted into a closed position with said nozzle portion nested in a portion of said spout recess.

6. A dispensing lid assembly as recited in claim 5, further comprising:

said base portion having a side wall and a partially domed head extending between said side wall and said spout recess; and said cover surface of said rotator spout defining a convex surface having a radius generally corresponding to a radius of said partially domed head portion.

7. A dispensing lid assembly as recited in claim 6, a trailing end of said cover surface extending from said arcuate portion of said rotator spout and abutting a ledge in said spout recess upon alignment of said through hole with said dispensing aperture.

8. A dispensing lid assembly as recited in claim 6, further comprising:

a pair of generally concave grip reveal surfaces positioned on said partially domed head on opposite sides of said nozzle portion of said rotator spout to facilitate gripping of said nozzle portion for pivoting said rotator spout into an open position.

9. A dispensing lid assembly as recited in claim 8, further comprising:

a pair of grip notches disposed on opposite surfaces of said nozzle portion of said rotator spout and aligned with said grip reveal surfaces for facilitating gripping of said rotator spout.

10. A dispensing lid assembly for use with a container for retaining and dispensing liquids from said containers, said dispensing lid assembly including a base portion and a displaceable spout retained on said base portion and displaceable relative thereto, said spout having a through hole communicating with a dispensing aperture in said base portion communicating with a cavity of said container for dispensing liquids therethrough, and a check valve assembly carried on said base portion of said dispensing lid assembly, said check valve assembly comprising:

a housing portion extending from a wall of said base portion of said lid, a cover extending over and retained on said housing defining a valve chamber therebetween;

a vent port extending through a wall of said base portion providing communication between ambient atmosphere and said valve chamber;

a breather port in said check valve providing communication between said valve chamber and said cavity; and a diaphragm retained in said valve chamber providing controllable passage of air through said vent port into said valve chamber and through said breather port to said cavity of said container for equalizing a vacuum created in said container upon dispensing liquid therefrom through said displaceable spout.

11. A dispensing lid assembly as recited in claim 10, in combination with a container having deflectable side walls.

12. A dispensing lid assembly as recited in claim 10, said check valve further comprising:

a sealing structure in said valve chamber, said diaphragm abutting said sealing structure to provide a seal therebetween;

at least one preloading protrusion extending from said cover inwardly into said valve chamber for pressing against said diaphragm, said preloading protrusion forcing said diaphragm against said sealing structure to provide a desired sealing force between said sealing structure and said diaphragm.

13. A dispensing lid assembly as recited in claim 10, said check valve assembly further comprising:

said sealing structure defining a shoulder of said housing extending inwardly from a wall of said housing for receiving said diaphragm thereon during assembly.

14. A dispensing lid assembly as recited in claim 13, said check valve further comprising:

said breather port in said check valve being positioned in close proximity to a perimeter of said diaphragm to facilitate transfer of air therethrough upon drawing air through said check valve assembly.

15. A dispensing lid assembly as recited in claim 12, said check valve assembly further comprising:

said preloading protrusion being centrally positioned relative to said diaphragm for pressing against a center area of said diaphragm for promoting uniform deformation of said diaphragm in said valve chamber;

a plurality of spaced apart tapered ribs extending between an inside surface of said cover and said preloading protrusion for limiting the amount of deflection of said diaphragm when drawing air through said check valve.

16. A dispensing lid assembly as recited in claim 15, further comprising:

said tapered ribs being spaced between neighboring breather ports to facilitate deflection of said diaphragm towards said breather port when drawing air through said check valve.

17. A dispensing lid assembly as recited in claim 16, further comprising:

said breather ports including a stop wall positioned thereabove to limit the movement of a perimeter of said diaphragm upon deflection thereof when drawing air through said check valve.

18. A dispensing lid assembly as recited in claim 10, further comprising:

said cover having a face wall with at least one hole therein, said hole providing communication between an interior portion of said valve chamber with said cavity of said container.

19. A dispensing lid assembly for use with a container, said dispensing lid assembly comprising:

a base portion for attachment to the container, said base portion defining a spout recess;

a wall of said spout recess having a dispensing aperture therethrough communicating with a cavity of said container, said dispensing aperture being disposed at an angle relative to a horizontal reference;

a rotator spout pivotally retained in said spout recess being pivotable from a closed position to an open position, said rotator spout having a through hole extending therethrough, said through hole communicating with said dispensing aperture when said spout is pivoted into an open position and being displaced from communication with said dispensing aperture when said spout is pivoted into a closed position;

a gasket retained on said base portion surrounding said dispensing aperture for forming a seal between said rotator spout and said dispensing aperture;

an arcuate portion of said rotator spout having a generally convex exterior surface; and an annular chord rim surrounding an entry port portion of said through hole and said rotator spout defining a flattened surface on said generally convex exterior surface of said arcuate portion for reducing the wear on said gasket retained proximate to said dispensing aperture.

20. A dispensing lid assembly as recited in claim 19, in combination with a container having deflectable side walls.

21. A dispensing lid assembly as recited in claims 19, said annular chord rim defining an obtuse angle with said arcuate exterior surface of said arcuate portion.

22. A dispensing lid assembly as recited in claims 19, further comprising:

a gasket retaining groove positioned around and radially spaced from said dispensing aperture for retaining said gasket therein, a retaining bevel extending between said dispensing aperture and said groove, said aperture having an upper edge and a lower edge with said upper edge having a larger dimension than said lower edge.

23. A dispensing lid assembly for use with a container for retaining and dispensing liquids from said containers, said dispensing lid assembly including a base portion and a displaceable spout retained on said base portion and displaceable relative thereto, said spout having a through hole communicating with a dispensing aperture in said base portion communicating with a cavity of said container for dispensing liquids therethrough, and a check valve assembly carried on said base portion of said dispensing lid assembly, said check valve assembly comprising:

a housing portion extending from a wall of said base portion of said lid, a cover extending over and retained on said housing defining a valve chamber therebetween;

a vent port extending through a wall of said base portion providing communication between ambient atmosphere and said valve chamber;

a breather port in said check valve providing communication between said valve chamber and said cavity;

a diaphragm retained in said valve chamber providing controllable drawing of air through said vent port into said valve chamber and through said breather port to said cavity of said container for equalizing a vacuum created in said container upon dispensing liquid therefrom through said displaceable spout;

said sealing structure defining a shoulder of said housing extending inwardly from a wall of said housing for receiving said diaphragm thereon during assembly; and a preloading protrusion extending from said cover inwardly into said valve chamber for pressing against said diaphragm, said preloading protrusion forcing said diaphragm against said sealing structure to provide a desired sealing force between said sealing structure and said diaphragm against said sealing structure.

* * * * *

UNITED STATES PATENT AND TRADEMARK OFFICE

CERTIFICATE OF CORRECTION

PATENT NO. : 5,890,628
DATED : April 6, 1999
INVENTOR(S) : Peter C. Simpson, et. al.

It is certified that error appears in the above-identified patent and that said Letters Patent is hereby corrected as shown below:

Title page, item [56], under References Cited insert the following:

FOREIGN PATENT DOCUMENTS

| | | |
|---|---|---|
| 4711647 | 10/12/72 | Japan |
| 59182223 | 12/5/84 | Japan |
| 5890051 | 5/28/83 | Japan |

Signed and Sealed this

Twenty-first Day of September, 1999

*Attest:*

Q. TODD DICKINSON

*Attesting Officer*

*Acting Commissioner of Patents and Trademarks*